US007312388B2

(12) United States Patent
Oskorep

(10) Patent No.: US 7,312,388 B2
(45) **Date of Patent: *Dec. 25, 2007**

(54) GUITAR PICK STICKERS WHICH PROVIDE A HIGHLY-PLASTICIZED FORMULATION OF MATERIAL TO SYNTHETIC GUITAR PICKS

(76) Inventor: John Jeffrey Oskorep, 416 W. Briar Pl, Unit #3, Chicago, IL (US) 60657

( * ) Notice: Subject to any disclaimer, the term of this patent is extended or adjusted under 35 U.S.C. 154(b) by 0 days.

This patent is subject to a terminal disclaimer.

(21) Appl. No.: 11/010,744

(22) Filed: Dec. 13, 2004

(65) Prior Publication Data

US 2005/0092159 A1 May 5, 2005

Related U.S. Application Data

(62) Division of application No. 10/408,270, filed on Apr. 7, 2003, now Pat. No. 6,846,977.

(51) Int. Cl.
*G10D 3/16* (2006.01)

(52) U.S. Cl. ..... 84/322; 40/594

(58) Field of Classification Search ..... 84/322, 84/320, 321

See application file for complete search history.

(56) References Cited

U.S. PATENT DOCUMENTS

| | | | | |
|---|---|---|---|---|
| 5,920,023 | A | 7/1999 | Ravagni et al. | |
| 6,040,512 | A * | 3/2000 | Polley | 84/322 |
| 6,846,977 | B2 | 1/2005 | Oskorep | |
| 2004/0074368 | A1 | 4/2004 | Oskorep | |
| 2004/0074369 | A1 | 4/2004 | Oskorep | |

FOREIGN PATENT DOCUMENTS

JP 59197483 A * 11/1984

* cited by examiner

*Primary Examiner*—Lincoln Donovan
*Assistant Examiner*—Jianchun Qin
(74) *Attorney, Agent, or Firm*—John J. Oskorep, Esq.

(57) ABSTRACT

Guitar pick stickers for adhering to synthetic guitar picks so that the picks may be held to a guitar are disclosed. Each sticker is sized to fit within a perimeter of a guitar pick. Each sticker has an adhering layer for adhesive attachment to the guitar pick and a highly-plasticized formulation of material (such as polyvinyl chloride, or static cling vinyl) for adhering the guitar pick to a glossy surface of a guitar without adhesive. A sticker sheet includes an adhesive backing sheet on which the stickers may be initially carried.

17 Claims, 2 Drawing Sheets

GUITAR PICK STICKERS WHICH PROVIDE A HIGHLY-PLASTICIZED FORMULATION OF MATERIAL TO SYNTHETIC GUITAR PICKS

CROSS-REFERENCE TO RELATED APPLICATIONS

This application is a divisional application of U.S. patent application entitled "Guitar Pick Stickers Which Impart A Magnetic Attraction To Synthetic Guitar Picks" having U.S. Ser. No. 10/408,270 and a filing date of 7 Apr. 2003, now U.S. Pat. No. 6,846,977 and claims priority thereto.

BACKGROUND

1. Field of the Invention

The present invention relates generally to the field of guitar picks and guitar pick holders, and more particularly to guitar pick stickers which provide magnetic attraction for synthetic guitar picks so that they may be magnetically held against an object such as a flexible magnet.

2. Description of the Problem

A guitar is typically played with a "guitar pick", which is used to strike or pluck strings of the guitar. Many guitar players carry a number of guitar picks with them as they are relatively small, easily lost, and inexpensive. However, it is often inconvenient to store or retrieve guitar picks. Guitar picks are typically carried in pants pockets and/or within guitar cases and need to be retrieved when the guitar is played. When a guitar is taken out of its guitar case, for example, a guitar pick must be retrieved from some location. Conversely, when a guitar is placed back in its case, the guitar pick must be stored somewhere. When a guitar player is playing and accidentally drops or intentionally tosses away the guitar pick, it is desirable to be able to quickly retrieve another one.

The majority of guitar picks are made from a plastic or synthetic material and provide a desired flexibility and durability. Guitar players have grown accustomed to the "look and feel" of such plastic guitar picks. Although some guitar picks are made entirely of a metal or perhaps metal alloy, such guitar picks are not as popular as plastic guitar picks. In addition, the appearance of guitars and guitar picks are fairly important to guitar players, and therefore it is preferable that any method used to hold or carry guitar picks does not detract from how these items look. Furthermore, guitar picks should be inexpensively made so that they may become commercially available and ubiquitous to a large number of consumers. Promotional and marketing techniques are also important in the industry.

Copending patent applications of the present inventor describe a magnetic solution for holding guitar picks, where a flexible magnet is adhered to a guitar and the guitar picks include a metal material. A flexible magnet "guitar pick holder" which carries such magnetically attractable guitar picks is the primary subject of copending patent applications entitled "Guitar Pick Holder Made Of A Flexible Magnetic Body" having U.S. Ser. No. 10/348,056 and a filing date of Jan. 21, 2003, and "Methods Of Making A Guitar Pick Holder Comprising A Flexible Magnetic Material" having U.S. Ser. No. 10/366,263 and a filing date of Feb. 13, 2003.

In copending patent application entitled "Guitar Pick Comprising A Blend Of Plastic And Magnetically Receptive Material" having U.S. Ser. No. 10/365,985 and a filing date of Feb. 13, 2003, a guitar pick is formed from a blend of plastic and metal material to have the look-and-feel of a plastic guitar pick but still be magnetically attractable.

Nonetheless, some guitar players are accustomed to using a particular guitar pick of their own preference and will refuse to use guitar picks that are different from them.

Accordingly, what is needed is a guitar pick solution which solves at least some of the aforementioned problems.

SUMMARY

Guitar pick stickers for adhering to synthetic guitar picks so that the picks may be held to a guitar are disclosed. Each sticker is sized to fit within a perimeter of a guitar pick. Each sticker has an adhering layer for adhesive attachment to the guitar pick and a highly-plasticized formulation of material (such as polyvinyl chloride, or static cling vinyl) for adhering the guitar pick to a glossy surface of a guitar without adhesive. A sticker sheet includes an adhesive backing sheet on which the stickers may be initially carried.

DETAILED DESCRIPTION OF THE PREFERRED EMBODIMENTS

Figure 1:
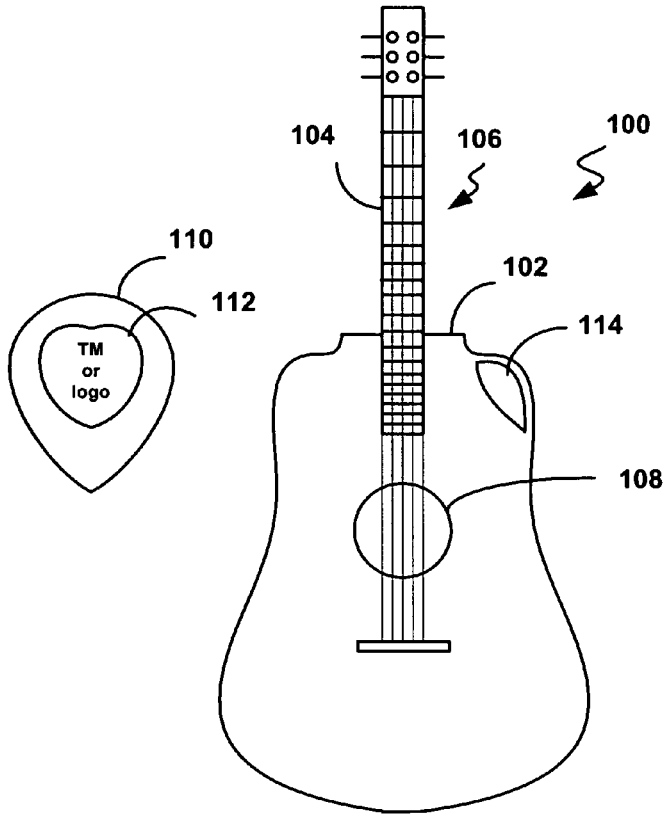
FIG. 1 is an illustration of a guitar pick holding system for a guitar which includes a flexible magnet and a synthetic guitar pick having a magnetically receptive guitar pick sticker adhered thereto.

FIG. 1 is an illustration of a guitar 100 and a guitar pick 110 for use in connection with a guitar pick holder of the present application. Guitar 100 is a conventional acoustic guitar having a guitar body 102, a neck 104, a sound hole 108, and a plurality of guitar strings 106 (six in total). Guitar 100 may alternatively be an electrical guitar, such as a 6-string electric guitar or a bass guitar. Guitar body 102 is typically made of wood, but could be made of other suitable materials. Typically, guitar body 102 has a transparent or translucent gloss finish. The plurality of guitar strings 106 are typically made of steel, some of which may be wound with nickel.

Guitar pick 110, which is shown in FIG. 1 in enlarged view relative to guitar 100, is typically made of a synthetic material, such as a plastic (e.g. nylon, delrin, tortex, celluloid, acetal, polypropylene, etc.). In this application, however, guitar pick 110 also includes a magnetically receptive layer 112 applied to a surface thereof. Magnetically receptive layer 112 may include any suitable material that is attracted by magnetic forces, and includes materials such as a metal (e.g. iron, nickel, cobalt, etc.), metal alloys, magnetic material, and others. In the present application, magnetically receptive layer 112 is preferably included as part of a guitar pick sticker. Guitar pick 110 may be provided or sold to an end user with sticker 112 already adhesively attached on the surface thereof. Alternatively, sticker 112 may be peelably removed from an adhesive backing sheet and adhered to a guitar player's own preferred guitar pick (e.g. see embodiment shown and described later in relation to FIG. 5).

A guitar pick holder which is used to magnetically carry guitar pick 110 is made from a flexible magnetic body 114. Flexible magnetic body 114 has a rear adhering surface for use in adhering to a surface of guitar body 102 and a front magnetic surface for use in magnetically carrying guitar pick 110. In general, a flexible magnet is a magnet that is flexible. Rubber or plastic is generally used in combination with magnetic material (e.g. ferrite magnetic powder) for making such a flexible magnet. Integrally formed together, these materials are typically used to make common "refrigerator" magnets. As an example, a flexible rubber magnet is basically a composite material which combines ferrite magnetic powder and compound rubber. Due to its characteristics, a rubber magnet can be easily formed into any complicated shape. Unlike a hard ferrite magnet which is normally fragile against to shock, a rubber magnet is flexible and not easy to break or crack. It may be manufactured with appropriate flexibility and cut into any size with a knife or scissors (or die cut) to meet a specific requirement. Flexible magnetic sheets, with or without adhering backing surfaces, may be obtained from any suitable manufacturer or company such as from Magnetic Specialty Inc. having offices at 707 Gilman Street, Marietta, Ohio, 45750, USA.

Figure 2:
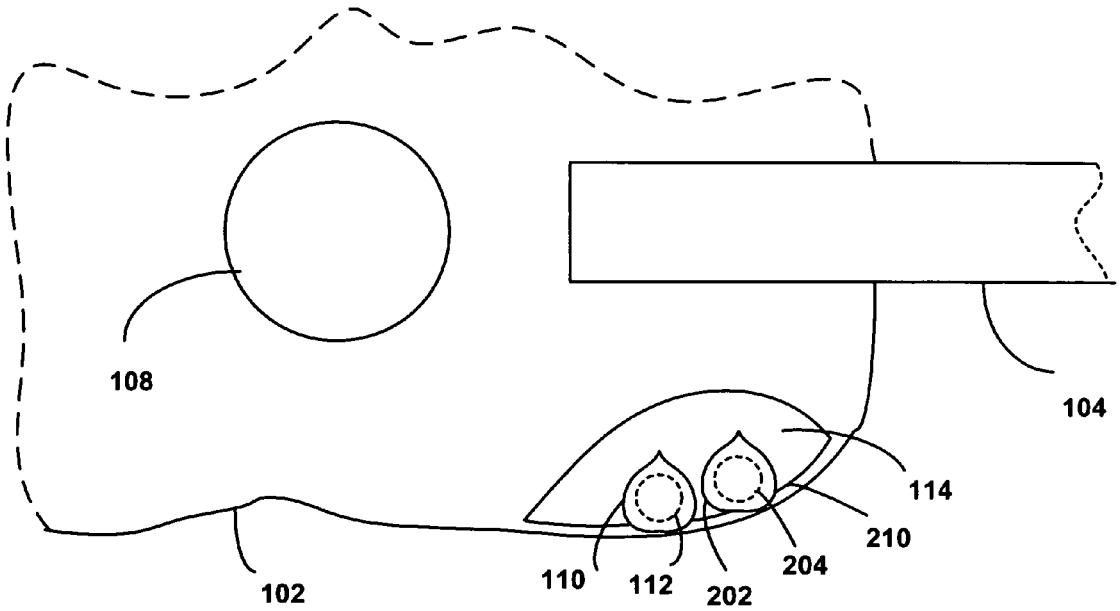
FIG. 2 is a close-up illustration of the guitar pick holding system of FIG. 1 in use with the guitar.

In FIG. 2, a close-up illustration of the guitar pick holding system of FIG. 1 in use with the guitar is shown. As shown, guitar pick 110 is held and carried over the outside front surface of guitar body 102 due to the magnetic attraction of sticker 112 to flexible magnetic body 114, which is adhered to the guitar's front surface. Guitar pick 110 remains magnetically held and carried even when the guitar is held in the position shown (i.e. guitar pick 110 being subject to downward gravitational forces) and even when it is subject to relatively strong forces of accelerative motion (i.e. guitar body 102 is physically handled or shaken). Shown in a dashed line, sticker 112 is adhesively attached to the pick surface opposite that shown in FIG. 2 such that relatively close surface-to-surface contact is made between sticker 112 and flexible magnetic body 114.

Preferably, flexible magnetic body 114 is positioned along a front bottom edge (right-handed perspective) above sound hole 108 of guitar 100, as shown in FIGS. 1 and 2. However, any suitable areas of attachment may be utilized. FIG. 2 also shows that one or more additional guitar picks 202 having a magnetically receptive sticker 204 may be included in the system. Preferably, flexible magnetic body 114 is thin (e.g. less than 5 mm or 0.2 inches in thickness) and has a length of between about 7.6-12.7 cm (between about 3-5 inches) to simultaneously accommodate a number of different guitar picks. Preferably, flexible magnetic body 114 has sufficient flexibility to maintain conformity to curved surfaces of guitar body 102 (e.g. curved side edges) if desired or needed.

Figure 3:
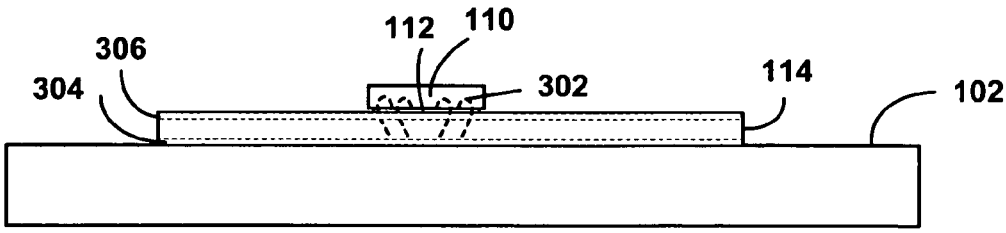
FIG. 3 is a cross-sectional view of the guitar pick holding system of FIGS. 1-2.

FIG. 3 is a cross-sectional view of the guitar pick holding system on guitar body 102 of FIG. 2. Thicknesses and relative thicknesses of the materials are exaggerated in FIG. 3 for illustrative purposes only. As shown, a magnetic surface of flexible magnetic body 114 provides a magnetic field 302 for magnetically attracting sticker 112 to thereby attract and hold guitar pick 110 against flexible magnetic body 114.

A viewable layer 306 of printed coloring and/or design may be applied over this front magnetic surface of flexible magnetic body 114. This layer may be or include a vinyl layer, a polyester layer, a clear coat layer, etc. A brand name may also be provided on the exposed viewable surface (e.g. printed using any suitable technique), which may additionally or alternatively include a visual design or graphics image, a company name, a company logo, a band name, a band logo, or a band player's name. In addition, an adhering layer 304 is provided on a rear surface of flexible magnetic body 114 opposite the front magnetic surface. Adhering layer 304 of flexible magnetic body 114 provides for a semi-permanent attachment of flexible magnetic body 114 to guitar body 102. The rear adhering surface of flexible magnetic body 114 is preferably planar so that it conforms and adheres well to a variety of non-planar surfaces (e.g. curved side edges) as well as planar surfaces of a guitar body 102.

Preferably, adhering layer 304 is a static cling vinyl layer. This static cling vinyl layer may be adhesively attached to the rear surface of flexible magnetic body 114. Static cling vinyl is typically used for decorative purposes, such as for seasonal window graphics, signs, decals, or protective masking applications. Static cling vinyl is a special formulation of polyvinyl chloride (PVC) to which a large amount of plasticizer (a liquid) has been added. This highly plasticized formulation is very pliable. The vinyl is typically calendered to give it a smooth finish. When such film is applied to a smooth glossy surface (e.g. a guitar body), it adheres firmly without the need for an adhesive. Because there is no adhesive, application is very easy and it can be removed and reapplied nearly indefinitely. Such static cling vinyl materials may be obtained from any suitable manufacturer or company, such as from Beacon Graphics having offices at 189 Meister Avenue, Somerville, N.J., 08876, USA. Although a particular formulation for static cling vinyl has just been described, other formulations may exist or be devised and the term "static cling vinyl" is intended to include such other alternative formulations which achieve the same results. Also, it is contemplated that the flexible magnet materials and static cling vinyl materials could be integrally formed or blended together in the same flexible magnetic body.

In an alternate embodiment, adhering layer 304 of flexible magnetic body 114 is an adhesive layer. The adhesive may be a heavy adhesive or light temporary adhesive, and preferably one which leaves no adhesive residue (e.g. an adhesive which provides for reapplication and repositioning, such as a Post-It™ notes type adhesive by Spencer Silver) and provides an impermanent bond. Most manufacturers typically provide flexible magnetic sheets with an optional adhesive backing. More particularly, a low-tack microvoided adhesive, called Supercling, is available from Plastiprint, Inc. of 445 Union Boulevard, Suite 209, Lakewood, Colo., 80228 USA. In yet another alternate embodiment, adhering layer 304 includes metal or magnetic material, which provides flexible magnetic body 114 with a magnetic attraction to a guitar body which has a metal or magnetic material surface.

Similar to the rear adhering surface, the front magnetic surface of flexible magnetic body 114 is preferably planar. A planar front magnetic surface provides a good "sliding" action for easy removal of guitar pick 110 (e.g. the thumb may press and slide the pick off the edge of guitar body 102, where it is captured between the thumb and index finger). In the case where the front magnetic surface is formed to be planar, there may be a concern that guitar pick 110 will tend to slide off of guitar body 102 due to forces of gravity or accelerative motion (e.g. sudden guitar movements). However, magnetic field 302 over this surface is made sufficient such that guitar pick 110 normally remains held against flexible magnetic body 114 even when guitar body 102 is physically handled and shaken. Although magnetic forces 302 provided by flexible magnetic body 114 are sufficiently large enough to magnetically hold guitar picks in this manner, they are also sufficiently small enough so as to not interfere with any electronics used in connection with the guitar.

Flexible magnetic body 114 is the primary subject of copending patent applications entitled "Guitar Pick Holder Made Of A Flexible Magnetic Body" having U.S. Ser. No. 10/348,056 and a filing date of Jan. 21, 2003, and "Methods Of Making A Guitar Pick Holder Comprising A Flexible Magnetic Material" having U.S. Ser. No. 10/366,263 and a filing date of Feb. 13, 2003.

Referring back to FIG. 1, guitar pick 110 is a standard conventional guitar pick made from a synthetic material. Guitar pick 110 may be made from, for example, a plastic, nylon, delrin, tortex, celluloid, acetal, polypropylene, etc. Guitar pick 110 has a body formed in a generally triangular shape from the synthetic material. This body is relatively thin in cross-section (with a thickness between about 0.5 mm and 2.0 mm), providing two generally planar surfaces for a guitar player to grip with a thumb and index finger. Planar surfaces of guitar pick 110 are preferred in the present application, as relatively large surface-to-surface contact between pick 110 and the magnet is best for keeping pick 110 held against the magnet.

In the present application, guitar pick 110 also has magnetically receptive guitar pick sticker 112 attached to an outer surface thereof. Guitar pick 110 may have one such sticker 112 for each surface thereof. The magnetically receptive material in sticker 112 may be or include, for example, a magnetically receptive metal layer (e.g. iron, nickel, or cobalt, or combination and/or alloy thereof). Metal alloys or blends of other suitable magnetically receptive materials may be utilized. In this embodiment, sticker 112 is adhesively attached to the outer surface of guitar pick 110.

Guitar pick 110 of FIG. 1 is shown in actual size as an example of a typical standard-sized guitar pick (about 3 cm in maximum length and 2.5 cm in maximum width). Sticker 112 is sized to fit within a perimeter of standard-sized guitar pick 110. Although sticker 112 is shown in FIG. 1 as being sized substantially smaller than guitar pick 110, preferably sticker 112 has substantially the same size and shape as guitar pick 110 although being slightly smaller than guitar pick 110. More preferably, sticker 112 covers at least ⅔ of the surface area of guitar pick 110. Also preferably, sticker 112 is opaque and is sized to entirely cover up any distracting text or graphics which may already exist on the guitar pick itself (since conventional guitar picks are usually branded with a trademark and/or design). An outer surface of sticker 112 preferably exposes a decorative coloring and a brand name, visual design, company name, or company logo, as shown in FIG. 1. The surface may be more personalized as well, providing for a band name, a band logo, a band player's name, or other. In alternative embodiments, sticker 112 is shaped in a thin ring or oval, a thin straight line (horizontal or vertical), a cross, or other different shapes, as some examples. In other alternate embodiments, the shape of sticker 112 actually forms the design, logo, or name.

Figure 4:
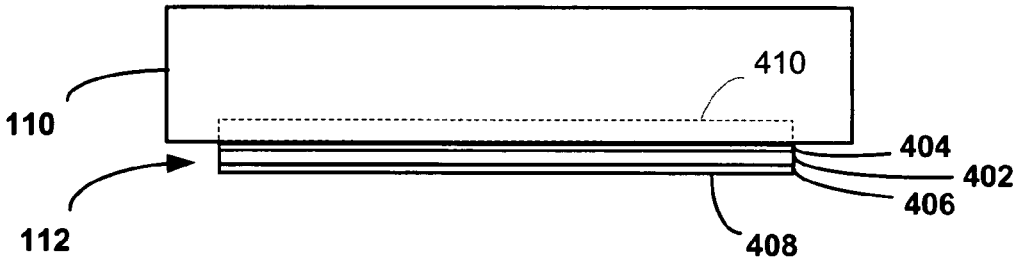
FIG. 4 is cross-sectional view of the guitar pick of FIG. 1 with the sticker adhesively attached.

Referring now to FIG. 4, a cross-section of guitar pick 110 of FIG. 1 having sticker 112 attached thereto is shown. Thicknesses and relative thicknesses of the materials are exaggerated in FIG. 5 for illustrative purposes only. Sticker 112 in FIG. 4 has an adhesive layer 404 for adhering to guitar pick 110, a magnetically receptive layer 402 for providing a magnetic attraction to a magnetic object, and a protective and/or decorative layer 406 formed over magnetically receptive layer 402. As shown, magnetically receptive layer 402 is "sandwiched" in between adhesive layer 404 and protective and/or decorative layer 406. Here, adhesive layer 404 is formed under as well as directly on magnetically receptive layer 402. Also preferably, adhesive layer 404 is an acrylic or acrylic-based adhesive. However, other suitable adhesives may be utilized.

Magnetically receptive layer 402 in sticker 112 may be a thin film or plate of metal. In the preferred embodiment, however, magnetically receptive layer 402 is a metal paper which is a blend of paper material and metal material. This metal paper may be made print-compatible and printed on with a coloring, design, or text. Alternatively, magnetically receptive material 402 may be a blend of metal material and vinyl. Such materials, with or without an adhering backing surface or other laminate, may be obtained from a suitable manufacturer or company such as from Magnetic Specialty, Inc. previously mentioned. This company provides materials suitable for the present application, including JetSTEEL™ material (0.11 mm or 0.0045 inches in thickness), PaperSTEEL™ material (0.254 mm or 0.010 inches in thickness, or 0.635 mm or 0.025" in thickness) with or without an adhesive laminate, ProMAG™ sheet material (0.3 mm or 0.012 inches in thickness), 0.4 mm or 0.015 inches in thickness, 0.5 mm or 0.020 inches in thickness, etc.), and others. JetSTEEL™, PaperSTEEL™, and ProMAG® are trademarks of Magnetic Specialty, Inc.

With use of such material, magnetically receptive layer 402 of sticker 112 may be relatively thin, having a thickness of 0.254 mm or less. Such raw materials are manufactured in relatively larger sheets or rolls, and are made to be die-cut for large scale production into smaller custom units. Such stickers may be readily made by those ordinarily skilled in printing and die cutting.

Protective/decorative layer 406 may be or include a thin protective coating (e.g. a clear coat, a gloss coat, or other suitable protective coating or layer) formed over the magnetically receptive layer 402. Such a protective layer 406 advantageously reduces the adverse affect from oils and acids from fingers of a guitar player on sticker 112. If metal paper is used as magnetically receptive layer 402, then the metal paper may be coated with protective layer 406 (e.g. a transparent protective coating) and then die cut to form multiple sticker shapes. In the die cutting process, the sheet material may be kiss cut so that multiple stickers remain carried by a single adhesive backing sheet. Here, no decorative appearance but the natural surface of the metal paper is exposed by layer 406. If merely a thin metal film is used as magnetically receptive layer 402, then the metal film may be coated with protective layer 406 (e.g. a transparent protective coating) and die cut to form multiple sticker shapes. Again, in the die cutting process, the material may be kiss cut so that multiple stickers remain carried by a single adhesive backing sheet. Here, no decorative appearance but the natural surface of the metal film is exposed by layer 406.

Preferably, an outer surface 408 of sticker i12 exposes a decorative coloring and a brand name, visual design, company name, or company logo (e.g. see FIG. 1) for sticker 112 and guitar pick 110. The outer surface 408 may be more personalized as well, providing for a band name, a band logo, a band player's name, or other. If metal paper is used as magnetically receptive layer 402, then the metal paper may be printed on (color, design, and/or text) and subsequently coated with protective layer 406, followed by a die cutting process to form the sticker shapes. Any suitable printing technique may be used, such as screen printing, label printing, offset printing, etc. In this case, decoration and/or text is provided on the metal paper (i.e. magnetically receptive layer 402) and protection is separately provided by transparent protective layer 406.

Alternatively, layer 406 is a layer of vinyl, polyester, or the like, which is applied over the metal film or metal paper. Such materials are typically provided with an adhesive laminate as an option. Such materials are sufficiently durable, provided with a suitable coloring and/or design, and can be printed on. In this case, such a layer 406 serves as both a protective and decorative layer for sticker 112. As an example, metal paper may be laminated with a vinyl which is subsequently printed on (design and/or text), followed by a die cutting process to form multiple sticker shapes. In this die cutting process, the laminated sheet may be "kiss cut" so that multiple stickers remain carried by a single adhesive backing sheet. Any suitable printing technique may be used, such as screen printing, label printing, offset printing, using colored/designed laminates including vinyl or paper. As some particular laminate examples, a black or white glossy vinyl may be utilized. As another example, a holographic material may be utilized. Holographic vinyl materials are available from manufacturers or companies such as Amagic Holographics, Inc. of Irvine, Calif., U.S.A. As another example, a glow-in-the-dark material may be utilized. Glow-in-the-dark vinyl materials are available from manufacturers or companies such as glowstickfactory.com, 485 Nantasket Avenue, Hull, Mass., 02045, U.S.A. Such a "glow" imparts a great advantage for such guitar picks, as never before have picks been so readily retrievable on guitar surfaces and, when lights are minimal or off, guitar players can readily see and access them. As even another example, a wood grain (e.g. maple or spruce) print may be provided on a vinyl or paper material formed or cut to fit the front magnetic surface, which is more suitable for acoustic guitars.

As another alternative for layer 406, if a metal film or plate is used as magnetically receptive layer 402, then protective layer 406 may be an electroplated film layer (e.g. nickel film or the like) which may be colored, printed, or etched on.

It has been determined that, using a ProMAG® magnetic sheet having a thickness of 0.30 mm (0.012 inches) (PSA=1016) to form a flexible guitar magnet, and using a medium thickness synthetic guitar pick (e.g. about 0.7 mm) having a piece of PaperSTEEL™ material adhesively attached to each surface thereof (surface area of each piece equal to about 80% of pick surface area), sufficient magnetic properties are present such that the guitar pick can be magnetically held to the flexible magnet. In addition, the guitar pick normally remains held even when the guitar is subject to typical forces of accelerative motion in this particular environment (i.e. when the guitar is physically handled and shaken). Even better results are made using a slightly thicker flexible magnet (e.g. thickness of 0.508 mm or 20 mils, or thickness of 0.762 mm or 30 mils). Of course, a wide range of other types of sufficient materials, material thicknesses, and material properties may be used to achieve these same results as one skilled will readily understand.

It has also been determined that, by providing a metal layer on a plastic surface of guitar pick 110, the metal layer's thickness in combination with its distance from the perimeter edges of guitar pick 110 may undesirably cause a tendency of guitar pick 110 to be tilted such that it falls off guitar body 102. In particular, if a guitar player's finger accidentally or intentionally depresses the edge of guitar pick 110 while it rests flat on flexible magnet 114, guitar pick 110 may be tilted such that the metal layer surface loses physical contact and magnetic attraction with the front magnetic surface of flexible magnet 114. The aforementioned problem may be avoided by forming guitar pick 110 with slight depressions each surface (e.g. see an optional depression 410 shown in pick 110 of FIG: 4), where each depression is sized to fit sticker 112 and has a depth that is about equal to the thickness of sticker 112. Preferably, sticker 112 has a top surface that is substantially flush with the top surface of the synthetic material in this embodiment. Thus, if guitar pick 110 is generally 0.8 mm in thickness and sticker 112 is 0.25 mm in thickness, guitar pick 110 may be formed with a depression of about 0.25 mm deep (on one or each surface) within which sticker 112 is adhered. The synthetic material in the center of guitar pick 110 would therefore be about 0.3 mm in thickness (assuming both sides are used). To otherwise reduce the occurrence of the aforementioned problem, alternatively the metal layers may be formed on each surface of guitar pick 110 so as to fully extend around the outside perimeter of guitar pick 110, with the exception that the plastic tip of guitar pick 110 would be exposed and without the metal layer.

In view of the above, sticker 112 may be made relatively thin to be suitable for use in attaching to guitar pick 110. For example, guitar pick sticker 112 may be less than 0.5 millimeters in thickness, and more preferably be between about 0.2-0.4 mm in thickness. The magnetically receptive layer in sticker 112 is preferably 0.254 mm or less.

Figure 5:
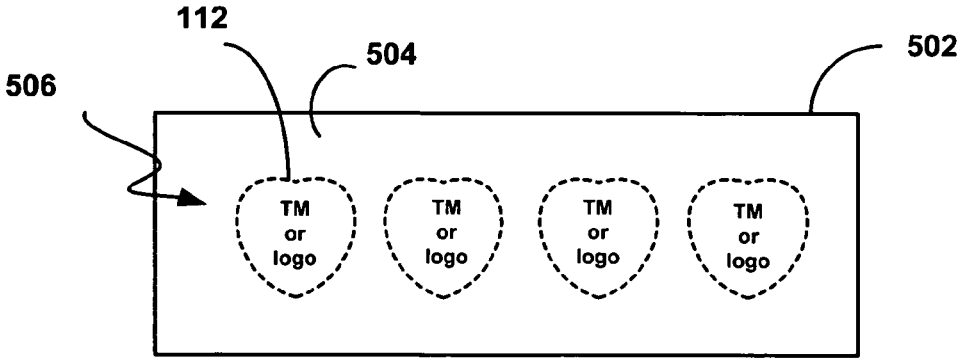
FIG. 5 is a front view of a sticker sheet on which a plurality of magnetically receptive guitar pick stickers may be initially carried and provided.

FIG. 5 is an illustration of a sheet 502 of a plurality of guitar pick stickers 506, such as guitar pick sticker 112 used on guitar pick 110, which may be formed as described above. Each guitar pick sticker 506 has a magnetically receptive layer, such as a thin film of metal, metal alloy, or other suitable material, including metal paper, as described above. Each guitar pick sticker 506 may be peelably removed from an adhesive backing sheet 504 and adhesively attached to one side of a standard guitar pick. Each guitar pick sticker 506 is sized to fit within the perimeter of a standard-sized guitar pick, and preferably includes a brand name, visual design, company name, or company logo. The stickers may be more personalized as well, providing for a band name, a band logo, a band player's name, or other. Preferably, each guitar pick sticker 506 is opaque and is sized to entirely cover up any other distracting text or graphics on the guitar pick itself. In alternative embodiments, each guitar pick sticker is shaped in a thin ring or oval, a thin straight line (horizontal or vertical), or a cross, as examples. In the preferred embodiment, the adhesive used on each guitar pick sticker is acrylic or an acrylic-based adhesive. As described above in relation to sticker 112 of FIGS. 1-4, each guitar pick sticker 506 has a thin protective coating or layer so as to reduce the adverse affect from oils and acids from fingers of the guitar player; a coloring, text, and/or design exposed on an outer surface; and an adhesive layer.

Different and Alternative Construction. In one different and alternative construction, a sheet of static cling vinyl is die cut into multiple "static cling vinyl stickers" provided for adhesive attachment to guitar picks, so that the guitar picks may be held directly to a glossy surface of a guitar by static cling vinyl adhesion. This sheet may be similar in appearance to that shown in relation to FIG. 4. The non-static cling side of the static cling vinyl sticker(s) has an adhesive laminate and backing sheet, which is removed prior to adhering the sticker to a guitar pick. Also prior to use, a protective backing sheet covers the static cling side of the static cling vinyl sticker(s). The static cling vinyl may be printed on the non-static cling side (in reverse or mirror image print) prior to application of the adhesive. Preferably, the adhesive used is an acrylic or acrylic-based adhesive.

Final Comments. Magnetically receptive guitar pick stickers have been described. These stickers can be adhered to synthetic guitar picks so that the picks can be magnetically held against an object, such as a magnet. Each sticker is sized to fit within a perimeter of a guitar pick and is relatively thin so as to be mostly unnoticeable when the guitar pick is gripped by an end user. A sticker sheet includes an adhesive backing sheet on which the stickers may be initially carried. Each sticker has a magnetically receptive layer (such as a metal layer) and an adhering layer formed between the magnetically receptive layer and the adhesive backing sheet. Preferably, a protective layer is formed over the magnetically receptive layer, and a color, text, and/or design is exposed by an outer surface of the sticker. Advantageously, a guitar player's preferred plastic guitar picks may be magnetically carried by the magnet (e.g. a thin flexible magnet) which is attached to a guitar or a guitar case.

It is to be understood that the above is merely a description of preferred embodiments of the invention and that various changes, alterations, and variations may be made without departing from the true spirit and scope of the invention as set for in the appended claims. The guitar utilized may be an acoustic or an electrical guitar, which may be a 6-string electric guitar or a bass guitar; a mandolin or other suitable instrument may be utilized as well. Although layers 402, 404, and 406 of FIG. 4 are shown to be formed directly on the other, intervening layers may be formed between such layers without departing from the invention, as one skilled in the art will readily appreciate. Thus, such a layer 402, 404, or 406 may be formed directly on the other or, alternatively, formed over or under the other with one or more intervening layers formed therebetween.

Few if any of the terms or phrases in the specification and claims have been given any special particular meaning different from their plain language meaning, and therefore the specification is not to be used to define such terms in an unduly narrow sense.

What is claimed is:

1. A sheet of guitar pick stickers for use in adhering to guitar picks so that the guitar picks are adapted to be removably carried against a glossy surface of a guitar, the sheet comprising:

an adhesive backing sheet;

a plurality of guitar pick stickers carded on the adhesive backing sheet;

each sticker being sized to fit within a perimeter of a guitar pick;

each sticker having:

a front outer surface comprising a highly-plasticized formulation of material for use in clinging, removably without adhesive, directly to a glossy surface of a guitar when applied thereto, such that the guitar pick may be regularly held against and removed from the glossy surface of the guitar during playing; and a rear adhering surface of an adhering layer which is formed between the highly plasticized formulation of material and the adhesive backing sheet for use in adhering to the guitar pick, such that the highly-plasticized formulation of material including its front outer surface is carried with the guitar pick when the guitar pick is removed from the glossy surface.

2. The sheet of claim 1, wherein the highly-plasticized formulation of material comprises polyvinyl chloride (PVC).

3. The sheet of claim 1, wherein the highly-plasticized formulation of material comprises static cling vinyl.

4. The sheet of claim 1, wherein each sticker further comprises:

a protective backing sheet which covers the highly-plasticized formulation of material.

5. The sheet of claim 1, wherein the front outer surface comprising the highly-plasticized formulation of material provides for static cling vinyl adhesion.

6. The sheet of claim 1, wherein the rear surface comprising the adhering layer is used for adhesive attachment of a sticker within a perimeter of a guitar pick after removal of the adhesive backing sheet.

7. A guitar pick sticker for use in removably carrying a guitar pick to a glossy surface of a guitar, the guitar pick sticker comprising:

a highly-plasticized formulation of material forming a front outer surface which clings, removably without adhesive, directly to a glossy surface of a guitar when applied thereto, so that the guitar pick may be regularly held against and removed from the glossy surface of the guitar during playing;

a rear adhering surface of an adhering layer formed adjacent the highly plasticized formulation of material; and a surface area of the sticker being sized sufficiently for adhesive attachment within a perimeter of the guitar pick with use of the rear adhering surface of the adhering layer, such that the highly-plasticized formulation of material including its front outer surface is carried with the guitar pick when the guitar pick is removed from the glossy surface.

8. The guitar pick sticker of claim 7, wherein the highly-plasticized formulation of material comprises polyvinyl chloride (PVC).

9. The guitar pick sticker of claim 7, wherein the highly-plasticized formulation of material comprises static cling vinyl.

10. The guitar pick sticker of claim 7, further comprising:

an adhesive backing sheet formed over the adhesive layer.

11. The guitar pick sticker of claim 7, further comprising:

a protective backing sheet formed over the highly-plasticized formulation of material.

12. The guitar pick sticker of claim 7, which further includes the guitar pick.

13. The guitar pick sticker of claim 7, which is used with a method of:

receiving the sticker which is die cut into the surface area which fits within the perimeter of the guitar pick;

adhesively attaching the rear adhering surface of the sticker within the perimeter of the guitar pick; and applying the front outer surface of the sticker directly against the glossy surface the guitar along with the guitar pick so that the guitar pick is held and carried directly against the glossy surface of the guitar.

14. A guitar pick, comprising:

a plastic material which forms the guitar pick;

a highly-plasticized formulation of material adhesively attached to an outside surface of the plastic material of the guitar pick;

an adhesive layer formed between the highly-plasticized formulation of material and the outside surface of the plastic material for adhesively attaching the highly-plasticized formulation of material to the outer surface of the plastic material of the guitar pick; and the highly-plasticized formulation of material forming a front outer surface which is adapted to cling, removably without adhesive, directly against a glossy surface of a guitar when applied thereto, such that the guitar pick may be regularity held against and removed from the glossy surface of the guitar during playing, where the highly-plasticized formulation of material including its front outer surface is carried with the guitar pick when the guitar pick is removed from the glossy surface.

15. The guitar pick of claim 14, wherein the highly-plasticized formulation of material comprises polyvinyl chloride (PVC).

16. The guitar pick of claim 14, wherein the highly-plasticized formulation of material comprises static cling vinyl.

17. The guitar pick of claim 14, further comprising:

an adhesive backing sheet formed over the adhesive layer.

* * * * *